US005133300A

United States Patent [19]

Miura

[11] Patent Number: 5,133,300

[45] Date of Patent: Jul. 28, 1992

[54] BACKPACK TYPE OPERATING UNIT

[75] Inventor: Takashi Miura, Tokyo, Japan

[73] Assignee: Komatsu Zenoah Company, Japan

[21] Appl. No.: 633,362

[22] Filed: Dec. 28, 1990

[30] Foreign Application Priority Data

Oct. 4, 1990 [JP] Japan ..... 2-104009[U]

[51] Int. Cl.[5] ..... B66D 3/00

[52] U.S. Cl. ..... 123/2; 224/212; 224/263

[58] Field of Search ..... 224/151, 153, 210, 211, 224/212, 261, 262, 263, 270; 123/2, 179 D, 195 A

[56] References Cited

U.S. PATENT DOCUMENTS

| | | | |
|---|---|---|---|
| 2,606,701 | 8/1952 | Huthsing | 224/210 |
| 3,265,260 | 8/1966 | Romney | 224/212 |
| 3,648,907 | 3/1972 | Romney | 224/212 |
| 4,145,028 | 3/1979 | Kelley et al. | 224/263 |
| 4,552,100 | 11/1985 | Kawaharazuka et al. . | |
| 4,572,414 | 2/1986 | Blatt | 224/212 |
| 4,658,778 | 4/1987 | Gamoh et al. . | |
| 4,930,467 | 6/1990 | Masuda et al. | 123/179 D |
| 5,011,058 | 4/1991 | Sapp et al. | 224/261 |

FOREIGN PATENT DOCUMENTS

| | | |
|---|---|---|
| 64-28972 | 2/1989 | Japan . |
| 2159381A | 12/1985 | United Kingdom . |

*Primary Examiner*—Tony M. Argenbright
*Assistant Examiner*—M. Macy
*Attorney, Agent, or Firm*—Marger, Johnson, McCollom & Stolowitz, Inc.

[57] ABSTRACT

Disclosed is a backpack type operating unit, which includes a backpack frame having a front portion and a left lateral side portion, an operating device and a motive power source for driving the operating device. The motive power source and the operating device is mounted on the backpack frame, and the front portion of the backpack frame faces toward a forward direction and the left lateral side portion facing toward a leftward direction, in which the forward direction and the leftward direction are perpendicular to each other and lying in a common horizontal plane. The operating unit comprises a supporting member mounted on the left lateral side portion of the backpack frame, a substantially longitudinal arm having two opposite end portions, the arm being pivotably mounted on the supporting member at one of the end portions so that the arm can be pivoted between a first pivotal position in which the arm points vertically upward with respect to the horizontal plane and a second pivotal position in which the arm points toward an inclined direction between the forward direction and the leftward direction, and mechanism provided on the arm for operating the motive power source.

13 Claims, 5 Drawing Sheets

BACKPACK TYPE OPERATING UNIT

BACKGROUND OF THE INVENTION

1. Field of the Invention

This invention relates to a backpack type operating unit, more particularly to a backpack type operating unit having an operating device such as a chemical dispersion device, a blower or the like and a motive power source for driving the operating device such as an engine, both of which are mounted on a backpack frame.

2. Description of the Prior Art

One example of the conventional backpack type operating units having an operating device and an engine power is illustrated in U.S. Pat. No. 4,552,100, in which the operating unit is provided with an arm having a throttle lever on its end for operating the engine. This arm is pivotably supported on a support member which is secured to the left lateral side of the operating unit so that the arm can be pivoted on a vertical plane at the left lateral side of the operating unit. According to the conventional unit, when operating the operating unit, the arm is pivoted forward on the plane so as to point straight toward the forward direction of the unit. On the other hand, when the operating unit is housed, the arm is pivoted on the plane so as to point vertically and upwardly.

However, according to the conventional operating unit, when the arm points straight toward the forward direction of the unit, it extends along the side of an operator. As a result, the arm is liable to strike the body of the operator, depending on the type of operation and the physical characteristics of the operator, which results in the inconvenience during the operation of the unit.

To solve this problem, an improved operating unit as disclosed in Laid Open Japanese Utility Model Application No. 64-28972 has been proposed. In the proposed operating unit. A mounting surface of the arm is faced toward a direction inclined downwardly and rearwardly with respect to the leftward direction of the operating unit in such a manner that the arm is rotated on a plane inclined with respect to the vertical plane generated at the lateral side of the operating unit. As a result, when the arm is pivoted forward to the front pivotal position, it points toward a direction inclined leftwardly with respect to the forward direction of the operating unit, that is, it extends toward a direction far from the operator. So that the arm rarely contacts with the body of the operator during the operation.

However, in the proposed operating unit, the arm is inclined outwardly not only at the front pivotal position but also at the upper pivotal position. Namely, even when the arm is provided upwardly, it is inclined outwardly with respect to the operating unit. This means that when the arm is pivoted upward to the operating unit, the arm remains being outwardly protruded. Consequently, the arm is likely to be damaged if it comes into contact with surroundings. Therefore, this outward inclination of the arm at the upper pivotal position is undesirable. Further, since the mounting surface of the arm is faced toward the direction as described above, that is, downwardly and rearwardly, a process of manufacturing a die of the arm is complicated.

SUMMARY OF THE INVENTION

An object of the present invention is to provide, with due consideration to the problems of such conventional apparatuses, a backpack type operating unit in which the arm points toward a direction inclined outwardly from the operator with respect to the forward direction of the operating unit at the front pivotal position during the operation, and when being stored of transported, the arm is pivoted so as to point vertically and upwardly or horizontally and rearwardly, in parallel with the side edge of the backpack frame.

This object is achieved in the present invention by a backpack type operating unit including a backpack frame having a front portion and a left lateral side portion, an operating device and a motive power source for driving the operating device, the motive power source and the operating device being mounted on the backpack frame, and the front portion of the backpack frame facing toward a forward direction and the left lateral side portion facing toward a leftward direction, the forward direction and the leftward direction being perpendicular to each other and lying in a common horizontal plane, the operating unit comprising: a supporting member mounted on the left lateral side portion of the back pack frame; a substantially longitudinal arm having two opposite end portions, the arm being pivotably mounted on the supporting member at one of the end portions so that the arm can be pivoted between a first pivotal position in which the arm points vertically upward with respect to the horizontal plane and a second pivotal position in which the arm points toward an inclined direction between the forward direction and the leftward direction; and means provided on the arm for operating the motive power source.

BRIEF DESCRIPTION OF THE DRAWINGS

The features and advantages of the backpack type operating unit according to the present invention over the proposed backpack type operating until will be more clearly understood from the following description of the preferred embodiments of the present invention taken in conjunction with the accompanying drawings in which the same reference numerals designate the same or similar elements or sections throughout the figures thereof and in which.

DETAILED DESCRIPTION OF THE PREFERRED EMBODIMENTS

Figure 1:
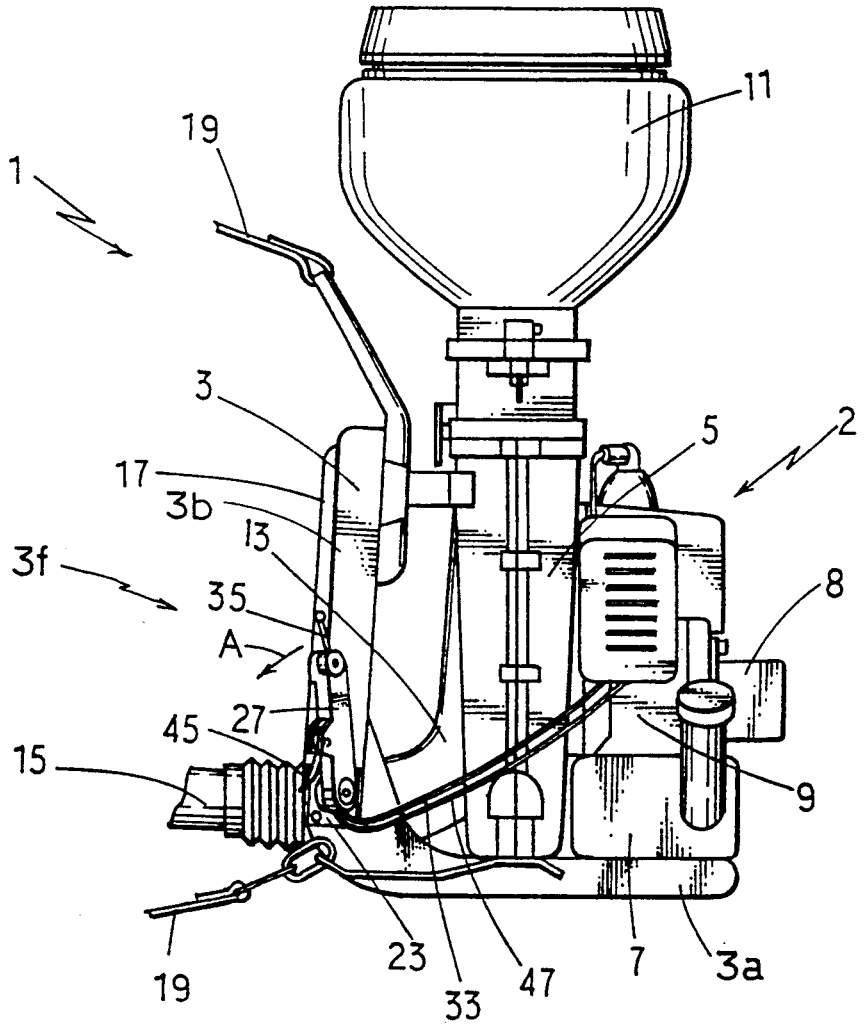
FIG. 1 is a side view of a first embodiment of the backpack type operating unit according to the present invention.

Referring now to the drawings, preferred embodiments of the backpack type operating unit according to the present invention will be described.

Figure 2:
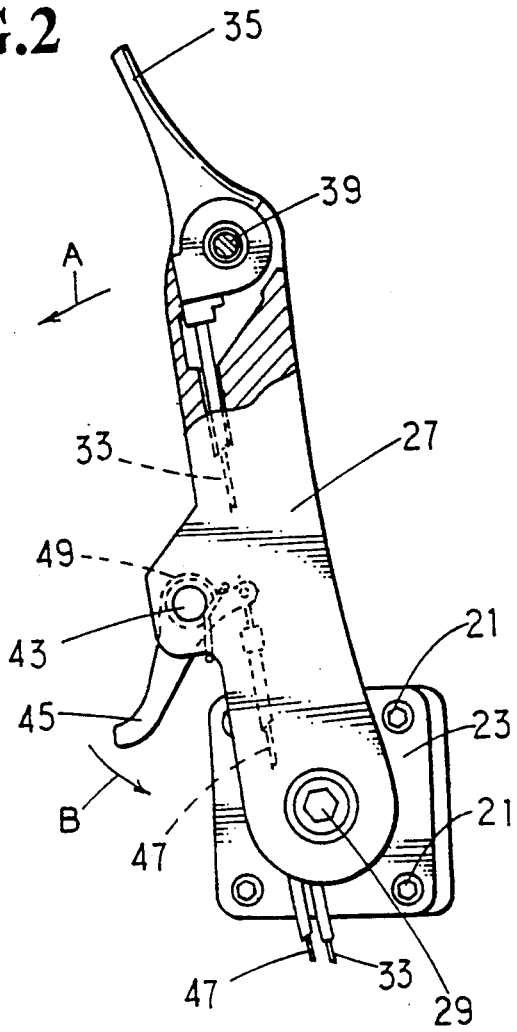
FIG. 2 is a side view showing the vertical position of the arm of the first embodiment.
Figure 3:
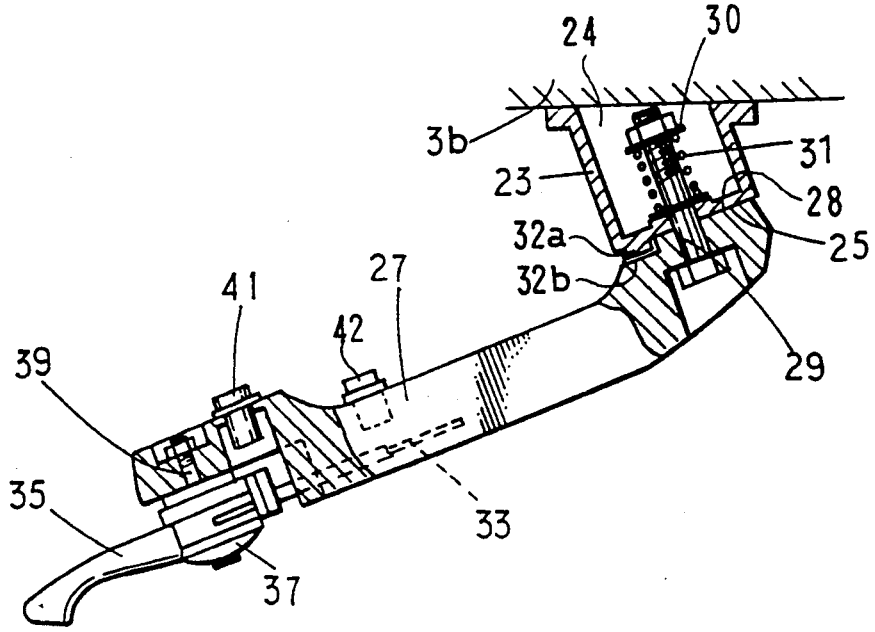
FIG. 3 is a sectional plan view showing the forward position of the arm of the first embodiment.

FIGS. 1 to 3 show a first embodiment of a backpack type operating unit of the present invention. As shown in the drawings, a backpack type operating unit 1 has the following configuration. Specifically, an operating device 2 (in this embodiment, a chemical dispersion device) is mounted on a backpack frame 3 of synthetic resin which has a horizontal portion 3*a* and a vertical portion 3*b* including a front portion 3*f*. The front portion 3*f* faces a forward direction when the unit is used. The operating unit 2 is provided with a fan casing 5 which incorporates a blowing fan, and a fuel tank 7. An engine 9 is mounted on the rear surface of the fan casing 5. A starting motor 8 for starting the engine 9 is provided on the rear portion of the engine 9. A chemical tank 11 is mounted on the top of the fan casing 5. An air tube 15 is connected to an air port 13 on the lower portion of the fan casing 5. The backpack frame 3 has a back contact pad 17 mounted on a front side of the vertical portion 3*b* of the backpack frame 3. A pair of backpack bands 19 are attached to the backpack frame 3 as shown in FIG. 1. During operation of the unit 1, an operator bears the operating unit 1 on his back under the condition that the front surface of the back contact pad 17 contacts with his back and each of the backpack bands 19 turns over his each shoulder.

The vertical portion 3*b* of the backpack frame 3 has a lateral side portion facing toward a leftward direction of the operating unit 1, that is leftward direction of the operator. The forward and leftward directions lie in the same horizontal plane, and are perpendicular with each other. On the lateral side portion of the vertical portion of the backpack frame 3, a support member 23 is mounted by screws 21. As shown in FIG. 3, a hollow section 24 is formed in the support member 23. A mounting surface 25 is defined on the support member 23. The mounting surface 25 is faced toward a direction inclined rearwardly at a predetermined angle with respect to the leftward direction of the operating unit 1. In other words, the mounting surface 25 is faced to the direction between the leftward and rearward directions of the operating unit 1. An arm 27 is pivotably mounted on the mounting surface 25 at the base portion thereof by means of a bolt 29 which penetrates the base portion and the mounting surface 25 perpendicularly to extend into the hollow section 24. The axis of the bolt 29 extends horizontally to the direction between the leftward and rearward directions of the operating unit, which is the same direction as the direction of the mounting surface 25. The longitudinal axis of the arm 27 is directed perpendicular to the axis of the bolt 29 which constitutes the pivotal axis of the arm 27.

A ring 30 is fitted on the top portion of the bolt 29 in the hollow section 24. A spring 31 is provided onto the bolt 29 between the back surface of the mounting surface of the support member 23 and the ring 30. The arm 27 is pressed at a preset pressure against the mounting surface 25 by the biasing force of the spring 31. A projection 32*a* is provided on the mounting surface 25. An arc-shaped groove 32*b* engageable with the projection 32*a* is provided on an end surface 28 of the arm 27. The projection 32*a* is fitted in the groove 32*b* when the arm 27 is mounted to the mounting surface 25 to restrict the pivotal angle of the arm 27 relative to the support member 23.

According to the above construction, the arm 27 is pivoted with respect to the axis of the bolt 29 on a plane including the plane of the mounting surface 25. As a result, when the arm is pivoted upward, the arm 27 points vertically upward as shown in FIGS. 1 and 2, and the operating unit 1 is housed or transported in this condition. When the unit is operated, the arm 27 is pivoted toward the direction shown by the arrow A in FIG. 2 to the front position in which the arm 27 points toward an inclined direction between the leftward and the forward directions of the unit 1 as shown in FIG. 3. Namely, the arm 27 is inclined toward the outside of the operator within the horizontal plane so as to be far from the operator.

On the tip portion of the arm 27, a throttle lever 35 is supported pivotably and retainably via a metal washer 37 by a bolt 39 so that the pivotal position of the throttle lever 35 can be shiftably and retainably adjusted with fingers. The throttle lever 35 is connected to an engine throttle valve (not shown in the drawing) by means of a wire 33 for operating the throttle valve. On the inner side surface of the tip portion of the arm 27, a push button type switch 41 is provided for stopping the engine 9 by shoring a primary ignition circuit of the engine. Another switch 42 of push button type is provided on the inner side surface of the center portion of the arm 27, which is connected to the electric circuit of the starting motor 8. On the lower surface of the center portion of the arm 27 in the front pivotal position (corresponding to the left side of the arm 27 of FIG. 2), a trigger-shaped choke lever 45 is pivotably mounted by means of a shaft 43 so that it can swing in a plane parallel to the pivotal plane of the arm 27. The choke lever 45 is connected to a choke valve (not shown in the drawing) of the engine through a wire 47. As shown in FIG. 2, the choke lever 45 is provided with a spring 49 as a biasing means. When the choke lever 45 is operated in the direction shown by the arrow B in FIG. 2, the choke valve is closed, and concentrated fuel is then fed into the cylinder. When the choke lever 45 is released, it is automatically pivoted by the spring 49 toward the direction opposite to the direction indicated by the arrow B, and then returns to the home position at which the choke valve is opened.

According to the above construction, when the engine 9 is started, the arm 27 is pivoted toward the direction shown by the arrow A from the upright position shown in FIGS. 1 and 2, so that it points to the inclined direction between the leftward and forward directions as shown in FIG. 3. The throttle lever 35 is maintained in an operating position which is suitable for starting. Then, the choke lever 45 is pulled against the spring 49 toward the direction shown by the arrow B in FIG. 2. When the starting switch 42 is pressed, the starting motor 8 is rotated and the engine 9 is then started. After this, the choke lever 45 is released to return to its home position, so that the engine 9 remains idling. During operation of the unit 1, the operator bears the operating unit 1 on his back and the arm 27 is pivoted so as to point in the inclined direction between the leftward and forward directions in FIG. 3. The operator grasps the air tube 15 which is provided at the right side of the operator with his right hand and operates the throttle lever 35 on the arm with his left hand, therefore the construction of the arm is suitable for the operator to operate the unit 1.

Figure 4:
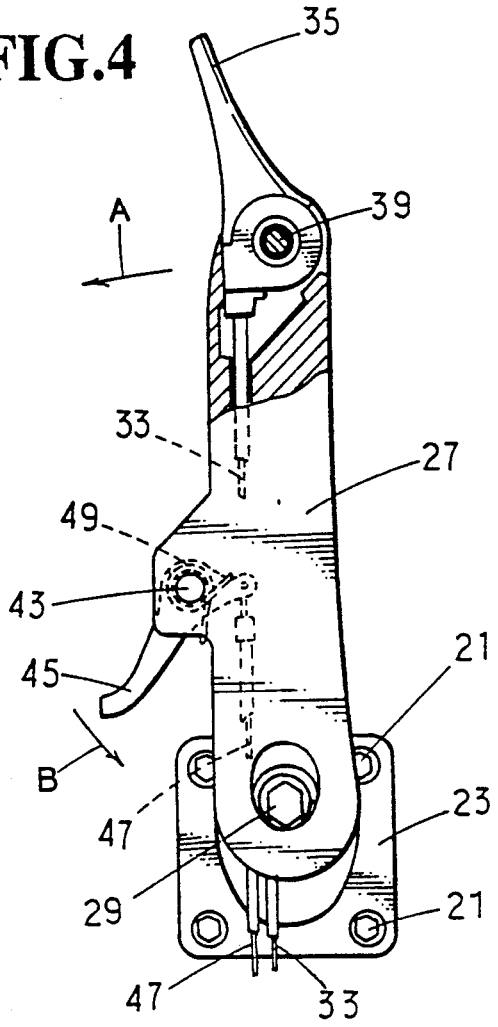
FIG. 4 is a side view showing the vertical position of the arm of a second embodiment of the present invention.
Figure 5:
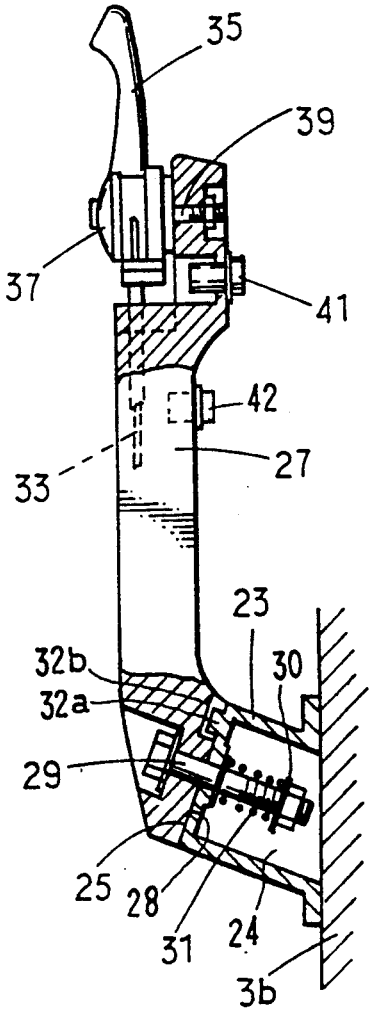
FIG. 5 is a sectional elevation view showing the vertical position of the arm of the second embodiment.
Figure 6:
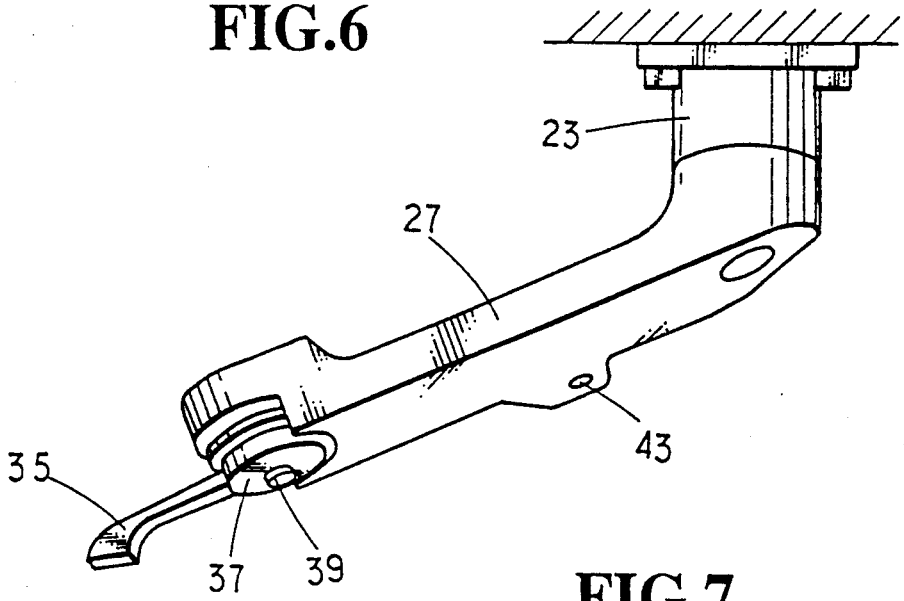
FIG. 6 is a plan view showing the forward position of the arm of the second embodiment.

FIG. 4 to FIG. 6 illustrate a second embodiment of the present invention.

As shown in FIGS. 4 and 5, a hollow support member 23 is secured to the left side portion of the vertical portion 3*b* of a backpack frame 3 by screws 21. A mounting surface 25 of the support member 23 is formed so that it is faced toward a direction inclined upwardly at a predetermined angle with respect to the horizontal plan within a vertical plane in which the leftward direction lies. In other words, the mounting surface 25 is faced to the direction toward the leftward and upward directions of the unit 1. An arm 27 is pivotably mounted on the support member 23 at the base portion thereof by a bolt 29 which perpendicularly penetrates the base portion and the mounting surface 25 of the support member 23. The arm 27 is provided so that it is pressed against the mounting surface 25 at a preset pressure by a spring 31 provided in the same manner as in the first embodiment. On the tip portion of the arm 27, a throttle lever 35 and an engine stop button 41 are provided. An engine start button 42 is provided on the center portion of the arm 27 in the same manner as in the first embodiment.

Although the longitudinal axis of the arm 27 in the first embodiment is perpendicular to the axis of the bolt which serves as the pivotal axis of the arm, in the second embodiment, the longitudinal axis of the arm 27 is not perpendicular to the axis of the bolt 29. Specifically, the angle of the longitudinal axis of the arm 27 with respect to the pivotal axis of the arm is provided so that it exceeds a right angle to the extent of the predetermined angle which corresponds to the angle that the bolt 29 is inclined upwardly with respect to the horizontal plane. Accordingly, the arm 27 does not pivot along a plane which includes the mounting surface 25 of the support member 23, but pivots along a conical surface which is generated around the pivotal axis of the arm. According to this construction, when the arm is pivoted upwardly, it stands vertically upright, and when it is pivoted forward, it points toward an inclined direction between the leftward and the forward directions.

In operating the unit 1, when the arm 27 is pivoted toward the direction shown by the arrow A from the position shown in FIG. 4 to the forward position, it points to the direction between the leftward and forward directions of the unit 1 as shown in FIG. 6. Accordingly, in the same manner as in the first embodiment, the arm can be operated in a condition where suitable space is conserved at the side of the operator. After the operation is finished, the arm 27 is pivoted toward the direction opposite to the direction shown by the arrow A in FIG. 4, and then it is housed with pointing vertically upright in parallel with the vertical portion of the backpack frame 3.

Figure 7:
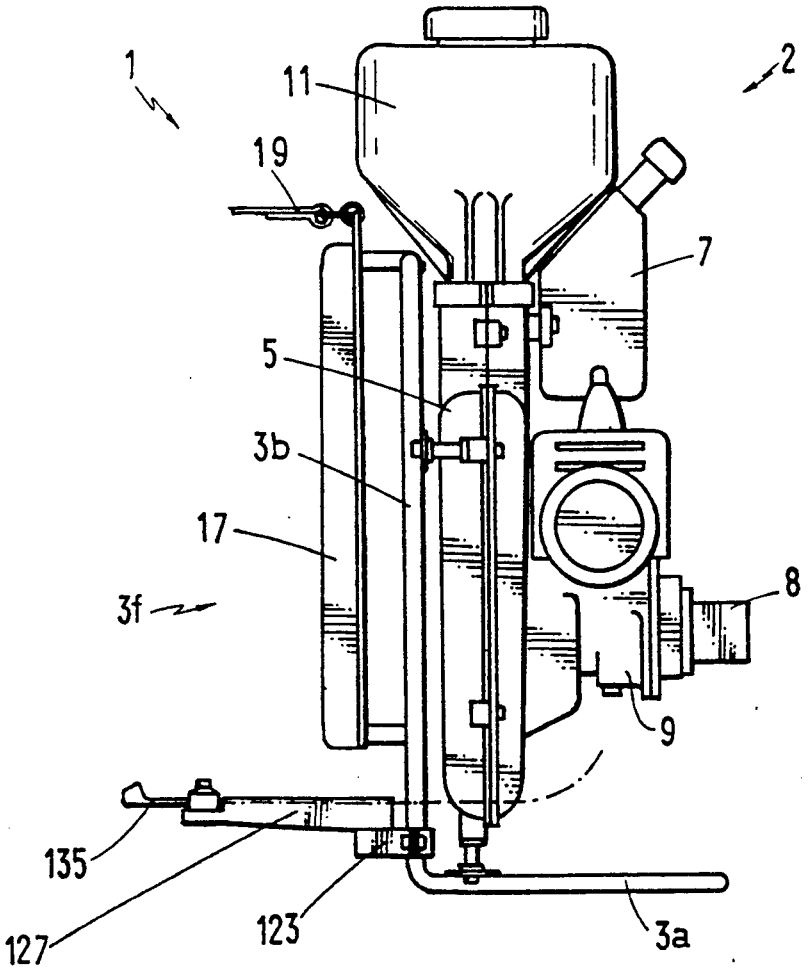
FIG. 7 is a side view of the arm of a third embodiment of the present invention.
Figure 8:
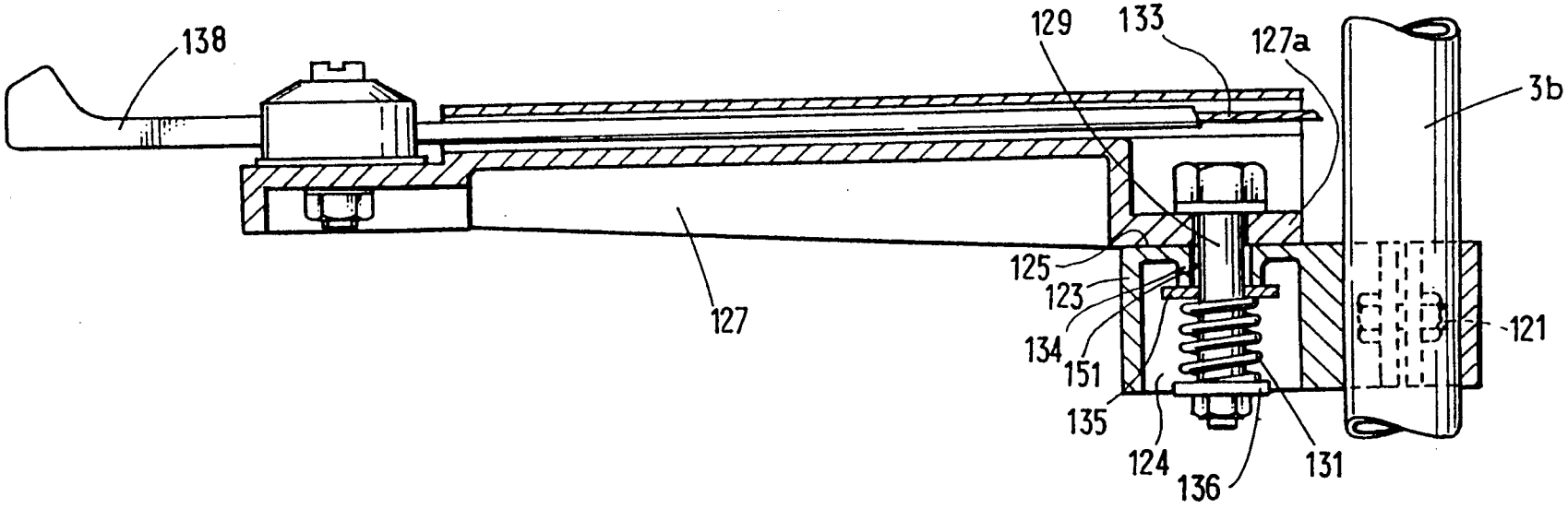
FIG. 8 is an enlarged side sectional view of the arm of the third embodiment.

FIG. 7 and FIG. 8 illustrate a third embodiment according to the present invention. It should be noted that in the following description of the embodiment, the same reference numerals as those used in the descriptions of the first and second embodiments denote the same components or structures. Further, the terms showing the directions have the same meanings as those used in the descriptions of the first and second embodiments, In this embodiment, the arm 127 is shiftably pivoted within the horizontal plane.

In FIGS. 7 and 8, a hollow support member 123 is secured to the vertical portion on the backpack frame 3 by a screw 121. A mounting surface 125 of the support member 123 is arranged horizontally and faced upwardly.

As shown in FIG. 8, in the mounting surface 125 of the support member 123, there is formed an aperture 151. A ring-shaped projection 134 which surrounds the aperture 151 and projects downwardly is formed on the bask side of the mounting surface 125. The arm 127 is pivotably supported on the support member 123 at the base portion 127*a* thereof by means of a bolt 129 which penetrates the base portion 127*a* and the aperture 151 of the mounting surface 125 and extends into the hollow section 124. The arm 127, in the same manner as the previous embodiments, is constructed so that it is pressed at a predetermined pressure against the mounting surface 125 by a spring 131 disposed onto the bolt 129 between ring washers 135 and 136. A throttle lever 138 is provided on the tip portion of the arm 127. In this embodiment, in the same manner as in the first embodiment, an engine start switch and a stop switch and the like may be provided on the arm 127.

In this third embodiment, when the unit is operated the arm 127 is pivoted to a front position in which it points in the inclined direction between leftward and forward directions by pivoting it toward the forward direction within the horizontal plane so as to have a certain space between the operator and the arm. Accordingly, it is possible to create an appropriate space between the arm 127 and the lateral side of the operator during the operation of the unit. After the operation, the arm 127 is pivoted horizontally and rearwardly, and then the operating unit is housed under the condition that the arm points in the rearward direction in parallel with the horizontal bottom portion 3*a* of the backpack frame 3. In this case, it is also possible for the arm 127 to pivot it toward the opposite direction so as to point the right forward direction in parallel with the front portion 3*f* of the backpack frame 3.

In this embodiment, the mounting surface 125 may be formed on the bottom of the support member 123 so as to face downwardly.

Finally, in these directions described above, each of the arms 27, 127 is mounted at the left lateral side portion of the unit. However, it is apparent that the arms can be mounted at the right lateral side portion of the unit.

It must be understood that the invention is in no way limited to the above embodiments and that many changes may be brought about therein without departing from the scope of the invention as defined by the appended claims.

What is claimed is:

1. A backpack type operating unit including a backpack frame having a front portion and a left lateral side portion, an operating device and a motive power source for driving the operating device, the motive power source and the operating device being mounted on the backpack frame, and the front portion of the backpack frame facing toward a forward direction and the left lateral side portion facing toward a leftward direction, the forward direction and the leftward direction being perpendicular to each other and lying in a common horizontal plane, the operating unit comprising:

a supporting member mounted on the left lateral side portion of the backpack frame;

a substantially longitudinal arm having two opposite end portions, the arm being pivotably mounted on the supporting member at one of the end portions so that the arm can be pivoted between a first pivotal position in which the arm points vertically upward with respect to the horizontal plane and a second pivotal position in which the arm points toward an inclined direction toward the forward direction and the leftward direction; and means provided on the arm for operating the motive power source.

2. A backpack type operating unit of claim 1, wherein the arm is mounted on the supporting member in such a manner that a pivotal axis of the arm is perpendicular to a longitudinal axis of the arm and extends toward a direction inclined rearwardly at a predetermined angle with respect to the leftward direction.

3. A backpack type operating unit of claim 1, wherein the arm is mounted on the supporting member in such a manner that a pivotal axis of the arm extends to a direction inclined upwardly at a predetermined angle with respect to the horizontal plane within a vertical plane in which the leftward direction lies, and an angle of a longitudinal axis of the arm with respect to the pivotal axis of the arm exceeds a right angle to the extent of the predetermined angle.

4. A backpack type operating unit of claim 2 wherein the supporting member has a mounting surface with which the one end portion of the arm slidably contacts, and the supporting member and the one end portion of the arm is coupled through a bolt which penetrates them along the pivotal axis of the arm.

5. A backpack type operating unit of claim 4, further comprising means for pressing the one end portion of the arm against the mounting surface of the supporting member at a preset pressure so that the pivotal position of the arm relative to the supporting member can be shiftably retained at an appropriate position between the first and second positions.

6. A backpack type operating unit of claim 5, wherein the pressing means includes a spring disposed onto the bolt in such a manner that the one end portion of the arm is pressed against the mounting surface of the supporting member.

7. A backpack type operating unit including a backpack frame having a front portion and a left lateral side portion, an operating device and a motive power source for driving the operating device, the motive power source and the operating device being mounted on the backpack frame, and the front portion of the backpack frame facing toward a forward direction and the left lateral side portion facing toward a leftward direction, the forward direction and the leftward direction being perpendicular to each other and lying in a common horizontal plane, the operating unit comprising:

a supporting member mounted on the left lateral side portion of the backpack frame;

a substantially longitudinal arm having two opposite end portions, the arm being pivotably mounted on the supporting member at one of the end portions so that the arm can be pivoted between a first pivotal position in which the arm points in the rearward direction opposite to the forward direction, but is not inclined outwardly, and a second pivotal position in which the arm points toward an inclined direction between the forward direction and the leftward direction; and means provided on the arm for operating the motive power source.

8. A backpack type operating unit of claim 7, wherein the arm is provided in such a manner that a pivotal axis of the arm extends toward a vertical direction with respect to the horizontal plane, and a longitudinal axis of the arm is perpendicular to the pivotal axis of the arm.

9. A backpack type operating unit of claim 8 wherein the supporting member has a mounting surface with which the one end portion of the arm slidably contacts, and the supporting member and the one end portion of the arm is coupled through a bolt which penetrates them then along the pivotal axis of the arm.

10. A backpack type operating unit of claim 9, further comprising means for pressing the one end portion of the arm against the mounting surface of the supporting member at a preset pressure so that the pivotal position of the arm relative to the supporting member can be shiftably retained at an appropriate position between the first and second positions.

11. A backpack type operating unit of claim 3, wherein the supporting member has a mounting surface with which the one end portion of the arm slidably contacts, and the supporting member and the one end portion of the arm is coupled through a bolt which penetrates them along the pivotal axis of the arm.

12. A backpack type operating unit of claim 11, further comprising means for pressing the one end portion of the arm against the mounting surface of the supporting member at a preset pressure so that the pivotal position of the arm relative to the supporting member can be shiftably retained at an appropriate position between the first and second positions.

13. A backpack type operating unit of claim 12, wherein the pressing means includes a spring disposed onto the bolt in such a manner that the one end portion of the arm is pressed against the mounting surface of the supporting member.

* * * * *

UNITED STATES PATENT AND TRADEMARK OFFICE

CERTIFICATE OF CORRECTION

PATENT NO. : 5,133,300
DATED : July 28, 1992
INVENTOR(S) : Takashi Miura

It is certified that error appears in the above-indentified patent and that said Letters Patent is hereby corrected as shown below:

| | |
|---|---|
| Column 1 | Line 38, change "unit. A" to --unit, a--; |
| Column 1 | Line 48, change "operator. So" to --operator, so--; |
| Column 1 | Line 53, change "provided" to --pivoted--; |
| Column 2 | Line 8, change "of" to --or--; |
| Column 3 | Line 33, after "is" insert --the--; |
| Column 3 | Line 57, change "top" to --tip--; |
| Column 5 | Line 11, change "toward" to --between--; |

UNITED STATES PATENT AND TRADEMARK OFFICE

CERTIFICATE OF CORRECTION

PATENT NO. : 5,133,300
DATED : July 28, 1992
INVENTOR(S) : Takashi Miura

It is certified that error appears in the above-indentified patent and that said Letters Patent is hereby corrected as shown below:

| | |
|---|---|
| Column 5 | Line 66, change "on" to --of--; |
| Column 7 | Line 4, change "toward" to --between--; |
| Column 8 | Line 26, delete "then". |

Signed and Sealed this

Eighth Day of March, 1994

*Attest:*

*Attesting Officer*

Bruce Lehman

BRUCE LEHMAN

*Commissioner of Patents and Trademarks*